US010829870B2

(12) United States Patent
Carlsson et al.

(10) Patent No.: US 10,829,870 B2
(45) Date of Patent: Nov. 10, 2020

(54) ELECTRICALLY CONDUCTIVE YARN AND A PRODUCT INCLUDING THE YARN

(71) Applicant: INUHEAT GROUP AB, Hovas (SE)

(72) Inventors: Stefan Carlsson, Bjarred (SE); Rickard Rosendahl, Kullavik (SE)

(73) Assignee: Inuheat Group AB, Hovås (SE)

( * ) Notice: Subject to any disclaimer, the term of this patent is extended or adjusted under 35 U.S.C. 154(b) by 102 days.

(21) Appl. No.: 16/063,648

(22) PCT Filed: Dec. 19, 2016

(86) PCT No.: PCT/SE2016/051289
§ 371 (c)(1),
(2) Date: Jun. 18, 2018

(87) PCT Pub. No.: WO2017/111687
PCT Pub. Date: Jun. 29, 2017

(65) Prior Publication Data

US 2019/0003083 A1 Jan. 3, 2019

(30) Foreign Application Priority Data

Dec. 22, 2015 (SE) ..... 1551703

(51) Int. Cl.
*D02G 3/12* (2006.01)
*D02G 3/44* (2006.01)

(52) U.S. Cl.
CPC ..... *D02G 3/12* (2013.01); *D02G 3/441* (2013.01)

(58) Field of Classification Search
CPC D02G 3/12; D02G 3/441; D02G 3/04; D02G 3/28; D02G 3/38
See application file for complete search history.

(56) References Cited

U.S. PATENT DOCUMENTS 3,882,667 A 5/1975 Barry
4,793,130 A * 12/1988 Togashi ..... D02G 3/12 57/210
5,617,713 A * 4/1997 Mawick ..... D02G 3/12 57/210
5,927,060 A * 7/1999 Watson ..... D02G 3/12 337/163

(Continued)

FOREIGN PATENT DOCUMENTS

CN 102251331 A 11/2011
CN 203128755 U 8/2013

(Continued)

OTHER PUBLICATIONS

Supplementary European Search Report and the European Search Opinion in European patent application No. 16879483.2, dated Sep. 30, 2019.

(Continued)

*Primary Examiner* — Shaun R Hurley
(74) *Attorney, Agent, or Firm* — Brooks Kushman P.C.

(57) ABSTRACT

An electrically conductive yarn having a fiber yarn which includes textile fibers and electrically conductive fibers. The fiber yarn is twisted with a filament yarn which is electrically conductive at least at its surface. The electrically conductive yarn can be used in different products in order to, for instance, create areas for heat emission and conductors for current to and from such areas and other components.

17 Claims, 3 Drawing Sheets

(56) References Cited

U.S. PATENT DOCUMENTS

| | | | | |
|---|---|---|---|---|
| 6,032,450 | A | 3/2000 | Blum | |
| 6,957,525 | B2 | 10/2005 | Verstraeten et al. | |
| 7,413,802 | B2 * | 8/2008 | Karayianni | D02G 3/328 428/370 |
| 7,923,390 | B2 * | 4/2011 | Burke | D02G 3/441 442/228 |
| 9,388,514 | B2 * | 7/2016 | Roh | D02G 3/441 |
| 2003/0209003 | A1 | 11/2003 | Verstraeten et al. | |
| 2004/0237494 | A1 * | 12/2004 | Karayianni | D02G 3/328 57/212 |
| 2005/0028512 | A1 | 2/2005 | Boni | |
| 2005/0282009 | A1 | 12/2005 | Nusko et al. | |
| 2012/0060963 | A1 * | 3/2012 | Song | D02G 3/441 139/420 R |
| 2012/0193342 | A1 | 8/2012 | Macher et al. | |
| 2015/0252499 | A1 * | 9/2015 | Lipscomb | D02G 3/441 442/301 |
| 2016/0145776 | A1 * | 5/2016 | Roh | D02G 3/441 57/211 |
| 2017/0058435 | A1 | 3/2017 | Couture et al. | |

FOREIGN PATENT DOCUMENTS

| | | |
|---|---|---|
| EP | 0564331 | 10/1993 |
| EP | 0564332 A1 | 10/1993 |
| EP | 1502976 | 2/2005 |
| EP | 2890216 | 5/2015 |
| WO | 03035951 | 5/2003 |

OTHER PUBLICATIONS

International Search Report for PCT/SE2016/051289, Completed by the Swedish Patent Office dated Mar. 21, 2017, 5 Pages.

* cited by examiner

ELECTRICALLY CONDUCTIVE YARN AND A PRODUCT INCLUDING THE YARN

CROSS-REFERENCE TO RELATED APPLICATION

This application is the U.S. national phase of PCT Application No. PCT/SE2016/051289 filed on Dec. 19, 2016, which claims priority to SE Patent Application No. 1551703-0 filed on Dec. 22, 2015, the disclosures of which are incorporated in their entirety by reference herein.

TECHNICAL FIELD

The present invention relates to an electrically conductive yarn, i.e. a yarn being capable of conducting electrical current. The electrically conductive yarn can be used in different products, for instance to create surfaces for heat emission and conductors for electrical current to and from such surfaces and other components.

BACKGROUND

Electrically conductive yarns have up to now most commonly been used in textiles to dissipate static electricity. In recent years, they have however also been used in other products, like actively heated articles of clothing. Such articles of clothing include heating elements that generates heat as a supplement to the user's body heat. The heating elements, which are created by means of electrically conductive yarns that are for instance knitted into or woven into the articles of clothing, are often powered by one of more batteries attached to the articles of clothing.

One example of an actively heated article of clothing is shown in U.S. 2012/0193342 which relates to an electrically heatable sock. A heating element is placed in the foot-part of the sock and through electrical conductors connected to a power source secured to the leg-part of the sock. The sock itself consists of woven, knitted or non-woven material of natural fibers, regenerated fibers or synthetic fibers. The heating element consists of a mix of non-conductive fibers on the one hand, and electrically and thermally conductive fibers on the other hand. The latter can be one from the following group of fibers: metal fibers, carbon fibers, metallized polymer fibers, conductive polymer-coated fibers, conductive polymer fibers or a combination of these materials. According to one embodiment the heating element may consist of a mix of natural and/or synthetic fibers on the one hand, and stainless steel fibers on the other hand.

There are several factors that are important in order for an electrically conductive yarn to function well in different products: The yarn should be strong, abrasion resistant and washable so that the products become durable. Furthermore, the yarn should be suitable for production. An electrically conductive yarn, which for example should be knitted into an article of clothing in order to form a heating element therein, should be capable of being handled by machines that are used to manufacture the article of clothing. In knitting machines the yarn is conveyed in paths with sharp bends where the yarn is temporarily exposed to relatively strong forces. If the yarn is not sufficiently strong and flexible it risks being torn off. The yarn should also have a resistance that is suitable for the intended field of use. It should be capable of being produced such that the yarn gets the desired resistance in all parts of the yarn. The resistance should moreover be stable both in a short and in a long perspective so that heat emission can be controlled in a reliable way and so that the yarn and the products that include the yarn preserve their properties over time. Yet another factor that is important in products used by humans and animals is that the yarn is comfortable against the body of the wearer.

It has been found that yarns consisting of a mix of natural and/or synthetic fibers on the one hand and electrically conductive fibers on the other hand are not fully satisfactory when it comes to the above factors.

There are also other types of known yarns capable of conducting electrical current. One example is a filament yarn that includes one or more filament fibers of metal. Such a yarn cannot however be handled by conventional textile machines. Nor does it satisfy the requirement of comfort for the user.

WO03/035951 shows a textile thread-like construction that is primarily used in woven products for shielding electromagnetic radiation. The thread-like construction comprises conductive and non-conductive fibers and has an insert in the form of an electrically conductive filament thread. The position of the filament thread varies in an irregular way. In some parts of the thread-like construction the filament thread is located at the surface and in other parts inside the construction.

SUMMARY

It is an objective of the invention to at least partly overcome one or more limitations of the prior art.

Another objective of the invention is to provide an electrically conductive yarn that is suitable for creating heat emitting areas or heating elements in different products.

Yet another objective of the invention is to provide an electrically conductive yarn that is suitable for creating conductors for electrical current to and from components in different products, particularly textile products and especially articles of clothing.

A further objective of the invention is to provide an electrically conductive yarn that satisfies a plurality of the abovementioned factors that are important in order for an electrically conductive yarn to function well in different products and in the production of these.

One or more of these objectives, as well as further objectives that may appear from the description below, are at least partly achieved by an electrically conductive yarn and a product according to the independent claims. Embodiments of the inventions according to the independent claims are defined by the dependent claims.

A first aspect of the invention is an electrically conductive yarn, comprising a fiber yarn, which includes textile fibers and electrically conductive fibers, twisted with a filament yarn which is electrically conductive at least at its surface.

By means of the electrically conductive filament yarn, a yarn is provided that has a more stable resistance both in a short and in a long perspective. Thereby a more reliable and more stable heat emission may be achieved when the yarn is used in for instance a heating element. The more stable resistance is achieved by the conductivity of the yarn being stabilized by the conductive surface of the filament yarn so that the conductivity becomes less dependent of contact points between the electrically conductive fibers in the fiber yarn.

By twisting the filament yarn with the fiber yarn, the filament yarn can be directed to a predictable and uniform position in relation to the fiber yarn. This makes it possible to manufacture an electrically conductive yarn with a predictable and stable resistance along its whole length. It also becomes possible to design a yarn with different properties depending on whether a high or low surface conductivity is desired in the completed yarn.

According to one embodiment the filament yarn is elastic in the longitudinal direction of the electrically conductive yarn. The elasticity may be achieved by a proper selection of material and/or implementation/construction/arrangement of the filament yarn. Since the filament yarn is elastic in the longitudinal direction, it can be used in textile products where for instance it may be integrated into the product by knitting, crocheting, weaving, sewing or a similar production method that requires the yarn to be temporarily stretched in the longitudinal direction. The electrically conductive filament yarn may according to one embodiment comprise a core of at least one filament fiber and a surface layer of electrically conductive material. In this way a filament yarn may be created that is flexible but still conducts current at its surface so that it may contribute to the creation of conductive paths between the electrically conductive fibers in the fiber yarn.

According to one embodiment, the surface layer of the filament yarn may consist of a thread of electrically conductive material that is wound around the core so that the filament yarn is electrically conductive at its surface along the whole length. The thread, which may be of metal, is preferably wound so closely that no gaps at all or only smaller gaps arise between the turns. When the composite yarn is stretched in the longitudinal direction, for instance in production or when the finished product is used, the wound metal thread on the filament yarn will be slightly pulled apart so that gaps between the turns arise or increase. When the stretch in the longitudinal direction is reduced, the gaps between the turns will decrease or disappear. In one embodiment the thread is flat, i.e. its thickness is substantially smaller than its width. The flat thread may consist of a thread-shaped foil.

The fiber yarn may suitably comprise 15-70 weight percent of electrically conductive fibers, more preferably 35-60 weight percent of electrically conductive fibers, and most preferably 40-50 weight percent of electrically conductive fibers. An increased share of electrically conductive fibers leads to an improved conductivity, but may result in inferior comfort properties, reduced durability and complicated production.

In one embodiment of the electrically conductive yarn, a filament yarn may be twisted with at least two fiber yarns in such a way that the filament yarn is positioned in the middle of the electrically conductive yarn and the fiber yarn at the surface of the electrically conductive yarn. Thereby the filament yarn can play its role without its electrically conductive surface layer affecting the comfort of a user of a product that includes the yarn.

In another embodiment of the electrically conductive yarn, a filament yarn may be twisted with a fiber yarn in order to form a double yarn, which in turn is twisted with a similar double yarn. Such an electrically conductive yarn may get a high surface conductivity and a good capability of conducting electrical current also in the cross direction of the yarn, something that could be advantageous in knitted products where the yarn is distributed only in the longitudinal direction of the knitting.

A second aspect of the invention is a product that includes an electrically conductive yarn of the above-mentioned type.

Still other objectives, features, aspects and advantages of the present invention will appear from the following detailed description, from the attached claims as well as from the drawings.

BRIEF DESCRIPTION OF DRAWINGS

Embodiments of the invention will now be described in more detail with reference to the accompanying schematic drawings.

DETAILED DESCRIPTION OF EXAMPLE EMBODIMENTS

Figure 1:
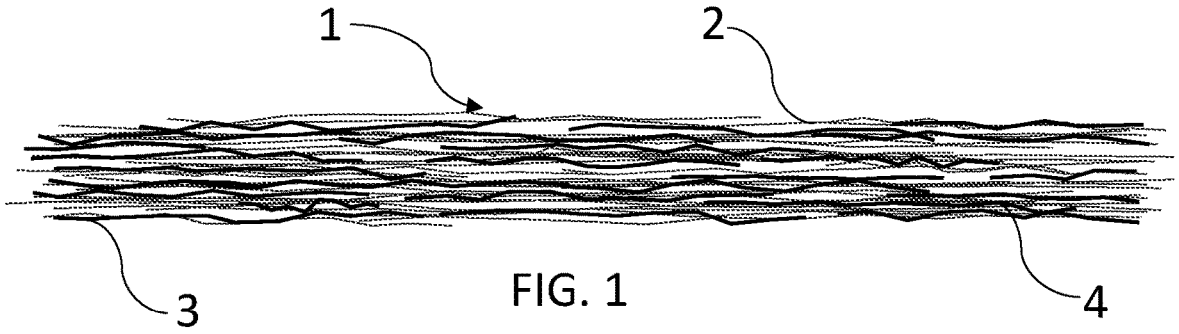
FIG. 1 is a side view and schematically shows how a fiber yarn may be structured.

FIG. 1 schematically shows an example of the structure of an electrically conductive fiber yarn 1. The fiber yarn comprises textile fibers 2 (gray in the drawing) and electrically conductive fibers 3 (black in the drawing) which may be spun together in order to form the fiber yarn. The textile fibers 2 may consist of natural fibers or synthetic fibers or a combination thereof. Such fibers do not conduct electrical current. As appears from the drawing, the electrically conductive fibers 3, below also called conductive fibers, are considerably shorter than the length of the yarn. Such fibers are sometimes called staple fibers. Also the textile fibers 2 are shorter than the length of the yarn and consequently constitute staple fibers, but in the example in FIG. 1 they are longer than the conductive fibers. In other fiber yarns the relative lengths of the fibers may be different. The length of the individual fibers of the respective material usually also varies. A fiber yarn which is spun of staple fibers is called a staple fiber yarn.

A fiber yarn that includes textile fibers and conductive fibers have some deficiencies with regard to conductivity. In order for the conductive fibers to be able to conduct current through the yarn, the fibers have to be in contact with each other so that the current can be conducted from fiber to fiber through the whole yarn. As appears from FIG. 1, the conductive fibers are however randomly distributed in the fiber yarn. At some locations the fibers contact each other, see for instance contact points 4. In such contact points the current can flow from one conductive fiber to another. The irregular distribution of conductive fibers may result in a fiber yarn with different resistance in different parts of its length. If furthermore a conductive fiber yarn is included in a product that is exposed to forces in one or more direction when it is used, as happen in for instance an article of clothing on a human, the fibers in the spun yarn will move in relation to each other. The contact points 4 between the conductive fibers will then be shifted. Some contact points will disappear and others will arise. As a result the conductivity/resistance of the fiber yarn will vary substantially, which makes it difficult to achieve a stable and reliable heat emission in the short time frame.

The conductivity of a fiber yarn may moreover change in a longer time frame. There are several different reasons for that. Wear and tear resulting in that fibers disappear from the yarn as well as oxidation resulting in deteriorated contact may be mentioned as examples.

Another related problem is that so called "hot spots" may arise if the contact points are few. Hot spots consist of points where a lot of current passes and where it consequently may become warmer than desired, which may be unpleasant for the user.

One idea to remedy these problems could be to increase the share of electrically conductive fibers in the fiber yarn, but it unfortunately results in inferior comfort properties, reduced durability and complicated use of the yarn in production.

By twisting a fiber yarn that includes textile fibers and electrically conductive fibers with a filament yarn that is electrically conductive at least at its surface, an electrically conductive yarn with advantageous properties with regard to conductivity, production, durability and comfort may be achieved.

By adding an electrically conductive filament yarn to the fiber yarn the conductivity of the composite yarn is stabilized. In addition to the contact points between the conductive fibers in the fiber yarn, also contact points between the conductive fibers and the filament fibers are created so that gaps between the conductive fibers may be bridged. Additionally, conductive paths are created for the electrical current in the filament yarn. In this way the composite yarn is less affected when it is exposed to impacts of different kinds. It has also been found that even if the filament yarn would break, the stable conductivity is maintained because the conductive fibers will bridge the breakage point. The fact that the filament yarn and the fiber yarn are twisted, moreover results in an even and stable distribution of the filament yarn in the completed composite yarn.

A filament yarn may include one or more filament fibers. A filament fiber is basically an infinitely long fiber. When it is included in a yarn, its length usually coincide with the length of the yarn.

Figure 2:
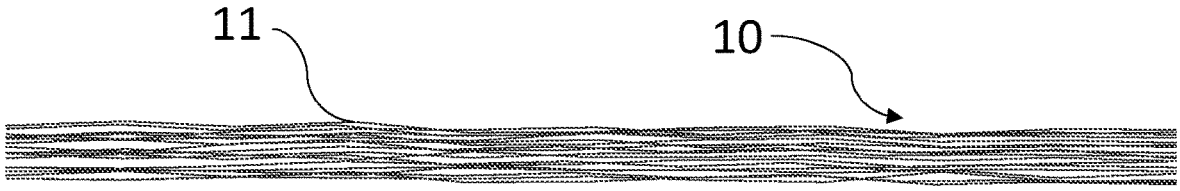
FIG. 2 is a side view and schematically shows how a filament yarn may be structured.

As already mentioned, the filament yarn that is used in the electrically conductive yarn is electrically conductive at least at its surface. In other words, the filament yarn is surface conductive. Thus, it may consist of a homogenous filament fiber of electrically conductive material. It may also consist of a plurality of filament fibers of electrically conductive material. One example of this is shown in FIG. 2 which schematically shows a filament yarn 10 which is composed of a plurality of filament fibers 11.

The filament yarn may also include a core of one or more filament fibers and a surface layer of electrically conductive material, that can but need not be continuous. In this case the filament fibers in the core need not be electrically conductive. The surface layers may be achieved by plating, coating, impregnation or similar technique.

Figure 3:
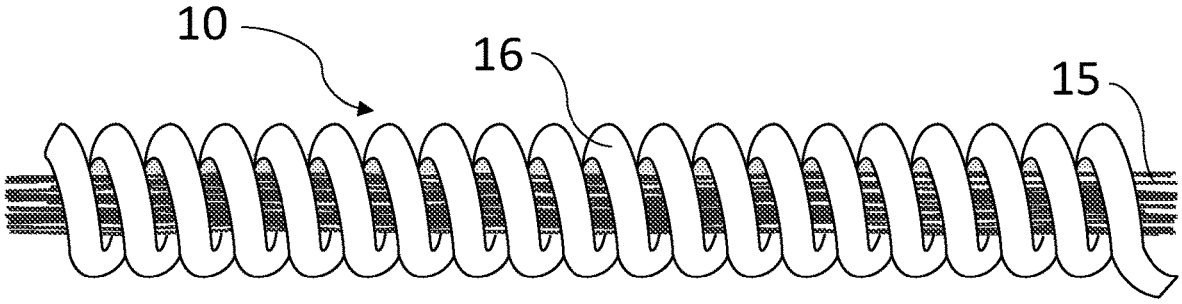
FIG. 3 is a side view and schematically shows another example of how a filament yarn may be structured.

FIG. 3 shows an example of a filament yarn 10 having a core 15 with a plurality of filament fibers where the electrically conductive surface consists of a thread 16 of electrically conductive material that is wound around the core. The thread may be massive or may have a surface layer that is achieved by plating, coating, impregnation or similar technique.

Figure 4:
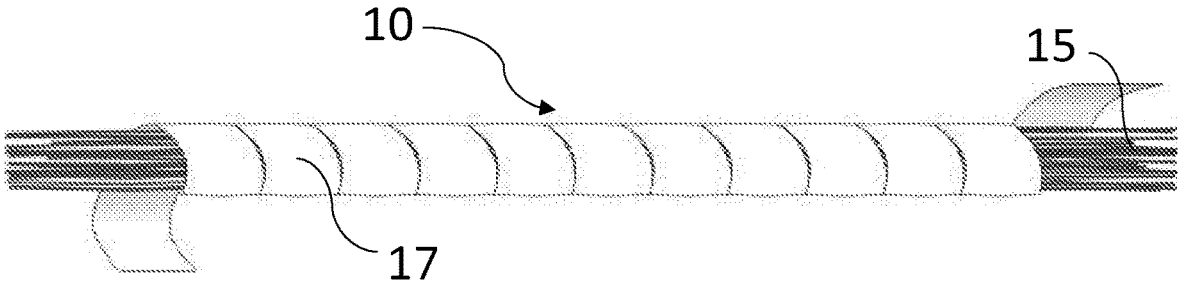
FIG. 4 is a side view and schematically shows yet another example of how a filament yarn may be structured.

FIG. 4 shows yet another example of a filament yarn 10 that has a core 15 with a plurality of filament fibers. In this case, the surface layer however consists of a flat thread 17 or a foil of electrically conductive material that is wound around the core. In the example of FIG. 4, the flat thread is wound so closely that a complete or continuous, electrically conductive surface layer is formed. Such a filament yarn is commercially available under the name "High-Flex" from Karl Grimm GmbH & Co. KG, Germany.

As has been seen above, a surface layer consisting of a wound thread results in a filament yarn that is flexible and elastic, which makes it suitable to be part of a composite electrically conductive yarn that should be used in conventional textile machines.

The number of filament fibers in the filament yarn may vary depending on the material and the thickness. Good results have up to now been achieved by 1-25 fibers, but other number of fibers are also conceivable. A benefit of using a plurality of thin filament fibers in a filament yarn is that fibers of a slightly more rigid or stiffer material can be used, but nonetheless a fiber yarn that is soft and flexible can be achieved.

As mentioned, it is beneficial if the electrically conductive yarn can be handled by conventional textile machines. In such machines, the yarn is usually exposed to forces in the longitudinal direction of the yarn. Consequently, it is advantageous if the yarn has a certain elasticity in the longitudinal direction of the yarn. A fiber yarn has a certain natural elasticity since it consists of shorter fibers that can move in relation to each other. A filament yarn of a non-elastic material lacks elasticity in itself, but given that the filament yarn is twisted with the fiber yarn and thus will be arranged in the shape of a helix, the twisting will result in a fiber yarn with a certain elasticity in the longitudinal direction of the composite conductive yarn. An elastic filament yarn may as an alternative or supplement be provided by a proper selection of constituent material. As mentioned it may consist of one or more synthetic fibers that have been impregnated by a metal-based powder so that the whole fiber/fibers become electrically conductive or for example by a silver or gold-plated synthetic fiber. Alternatively the filament yarn could be arranged in the shape of a helix or the like before the twisting with the fiber yarn. As yet another alternative an elastic fiber yarn may be achieved by the above, in connection with FIGS. 3 and 4 described, example with a thread wound around the core.

Figure 5:
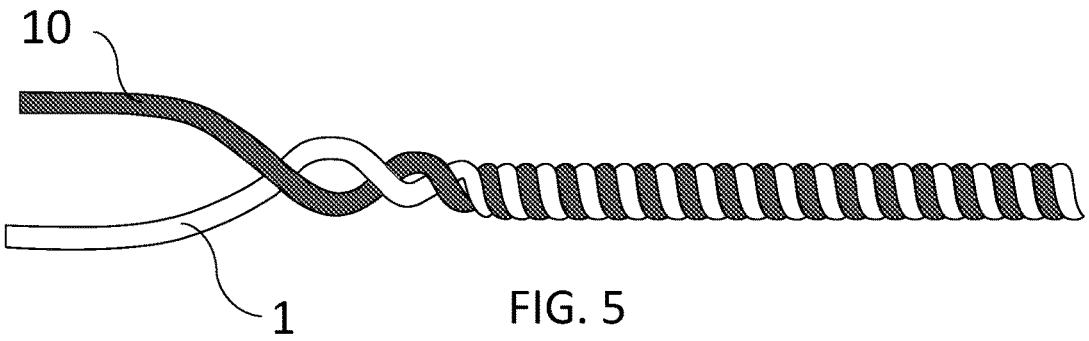
FIG. 5 is a side view and schematically shows how an electrically conductive yarn may be composed of a fiber yarn twisted with a filament yarn.

FIG. 5 shows an example of a fiber yarn 1 which is twisted with a filament yarn 10. It could be seen that the filament yarn has a helix shape and an even distribution in the composite yarn.

An electrically conductive yarn as described above may be used in many different applications. If the yarn is a low-conductive yarn with a high resistance/low conductivity of current it may for instance be used to create heating elements or heat emitting areas/surfaces in different products, particularly textile products, such as articles of clothing, blankets, car seats and linings of different kinds. It may also be used in order to create other components for integration into articles of clothing and other products. As an example sensors of different kinds can be mentioned. If the yarn is a high-conductive yarn with a low resistance/high conductivity for current it may for instance be used in order to create conductors to heat emitting areas in products according to the above, but also to other components that may be integrated in textile products especially. The yarn may also be used for digital and analog signal transfer to different components. Generally, by proper selection of material in the constituent yarns, proper selection of the shares of different fibers and proper selection of the shares of the different yarns (fiber yarns and filament yarns) and how these are twisted together, electrically conductive yarns with different properties may be designed for different applications.

If a yarn with low conductivity is desirable, a conductive material in the filament yarn that has higher or about the same resistance per meter as the conductive fibers in the fiber yarn should preferably be used. The filament yarn may moreover constitute a relatively low share, expressed in weight percent, in the composite electrically conductive yarn. Suitable conductive material for the filament yarn in low-conductive yarns may be constantan, tungsten, conductive polymers, stainless steel, bronze, or any combination thereof. A low-conductive yarn may have a resistance of 20-2000 Ohm/meter. In a heat emitting area which consists of a knitted, woven, sewed or with another textile production method provided area of low-conductive yarn, the current flows primarily through the yarn in the longitudinal direction of the yarn. For such an application, the constituent yarns are advantageously twisted such that the filament yarn is placed in the middle or in the core of the composite electrically conductive yarn, and the fiber yarn on the surface. In this way stable conductivity and great comfort for the user are achieved.

Figure 6:
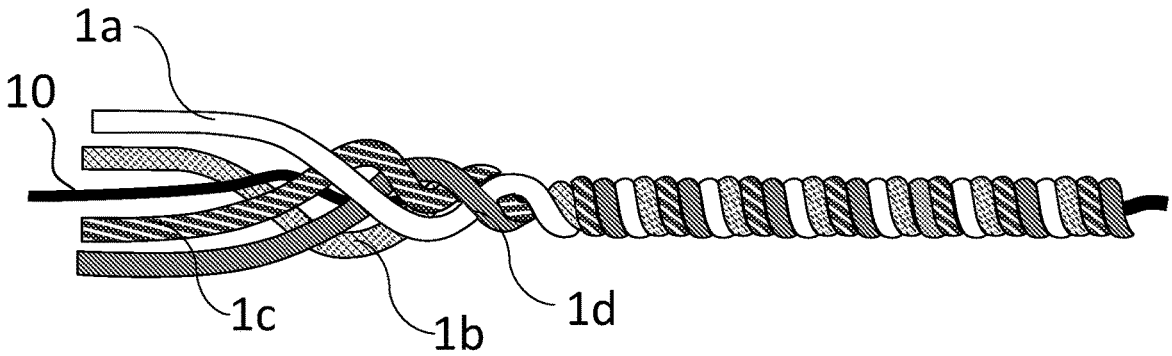
FIG. 6 is a side view and schematically shows an example of how an electrically conductive yarn may be composed of a filament yarn and several fiber yarns.

FIG. 6 schematically shows an example of how a low-conductive yarn may be twisted. The yarn is composed of a filament yarn 10 consisting of a plurality of electrically conductive filament fibers that are twisted with four electrically conductive fiber yarns 1*a*, 1*b*, 1*c*, and 1*d*. The number of fiber yarns may vary from one and upwards depending on the application. If the electrically conductive yarn shall be used in articles of clothing or other products which will get in direct contact with humans or animals, it may as has been mentioned above, be advantageous from a comfort perspective, to twist the filament yarn with more than one fiber yarn so that the outside of the composite yarn substantially consists of fiber yarn.

If instead a yarn with high conductivity is desirable, it may be suitable to use a conductive material in the filament yarn that has a lower resistance per meter compared to the conductive fibers in the fiber yarn. Moreover, the filament yarn may constitute a larger part, expressed in weight percent, in the composite electrically conductive yarn compared to in the low-conductive yarn. Suitable conductive material for the filament yarn in high-conductive yarns is gold (homogeneous or plating), silver, nickel, copper, brass, magnesium, tin, titanium or any combination thereof. A high-conductive yarn may have a resistance of 0.5-20 Ohm/meter. In a conductor consisting of a knitted, woven, sewed or with a different textile production method provided conductor of a high-conductive yarn, the current should usually be transferred both in the longitudinal direction of the yarn and in the cross direction thereof. For such an application, the constituent yarns are suitably twisted so that the filament yarn is placed at least partly at the surface of the composite electrically conductive yarn so that a satisfactory surface conductivity is obtained.

Figure 7:
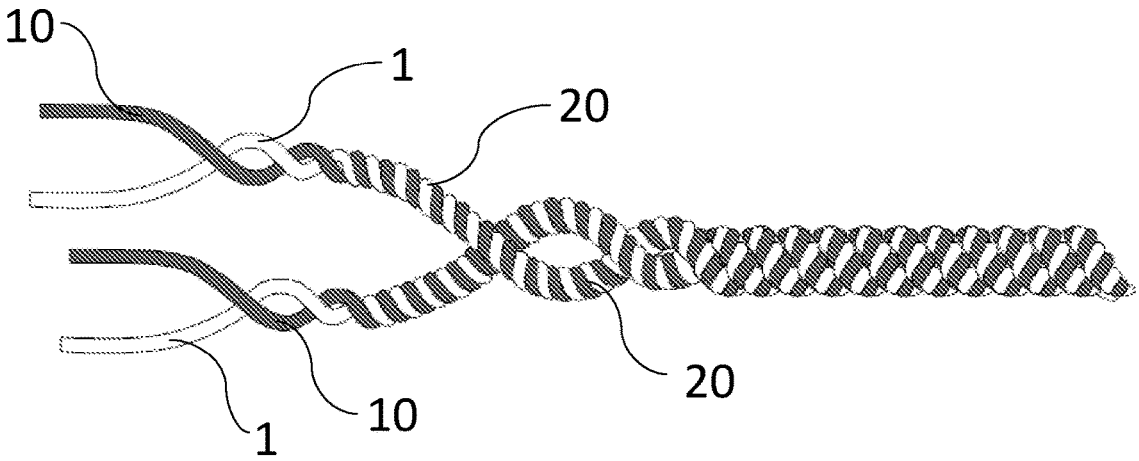
FIG. 7 is a side view and schematically shows how an electrically conductive yarn may be structured in another embodiment.

FIG. 7 schematically shows an example of how a high-conductive yarn may be twisted. The high-conductive yarn consists of a conductive filament yarn 10 (dark in the drawing) which is twisted with a conductive fiber yarn 1 (white in the drawing). The resulting double yarn 20 is thereafter twisted with a similar twisted conductive double yarn 20, i.e. a conductive fiber yarn 1 twisted with a conductive filament yarn, in order to provide a twisted 2×2 yarn with high surface conductivity. It is also conceivable to twist more than two twisted yarns so that a twisted Y×2 conductive yarn is obtained, where Y is larger than 2.

An electrically conductive yarn which can be handled in different conventional textile machines and which can be designed into different textile products in the same way as any standard yarn may be provided by twisting a conductive fiber yarn with a surface conductive filament yarn.

The conductive fiber yarn can be dyed as desired before as well as after it has been spun. Fibers that affect other functions than the capability of conducting current may be included both in the fiber yarn and in the filament yarn or may be part of a separate yarn that is twisted with the fiber yarn and the filament yarn in order to realize the desired appearance and function of the finished yarn.

The textile fibers of the conductive fiber yarn may for instance consist of conventional textile fibers, such as wool or polyester, different polymers, polypropylene.

The conductive fibers in the conductive fiber yarn may for instance consist of constantan, tungsten, conductive polymers, stainless steel, bronze or any combination thereof.

In a low-conductive yarn, the conductive fibers in the fiber yarn and the electrically conductive material in the filament yarn may be the same.

A suitable proportion of conductive fibers in the fiber yarn is currently believed to be 15-70 weight percent, preferably 35-60 weight percent and most preferably 40-50 weight percent.

The filament fibers may for instance consist of carbon fibers or polyester.

As an example a spun staple fiber yarn with 55 weight percent of polyester fibers and 45 weight percent of conductive fibers of stainless steel, and a filament yarn which includes a core with a bundle of 7 polyester threads and a surface layer consisting of a closely wound, flat constantan thread may be used in a low-conductive electrically conductive yarn which is suitable for use in heating elements in articles of clothing or similar textile products. A filament yarn is twisted with three staple fiber yarns in such a way that the filament yarn is placed in the middle of the conductive yarn surrounded by the staple fiber yarns.

A high-conductive electrically conductive yarn which is suitable to be used as a conductor between for instance a battery and a heat emitting area, may as an example consist of a filament yarn with filament fibers of polyester and a surface layer of nickel plated copper and a spun staple fiber yarn with 55 weight percent of polyester fibers and 45 weight percent of conductive fibers of stainless steel. The filament yarn and the fiber yarn may then be twisted to a 2×2 yarn as described above.

Figure 8:
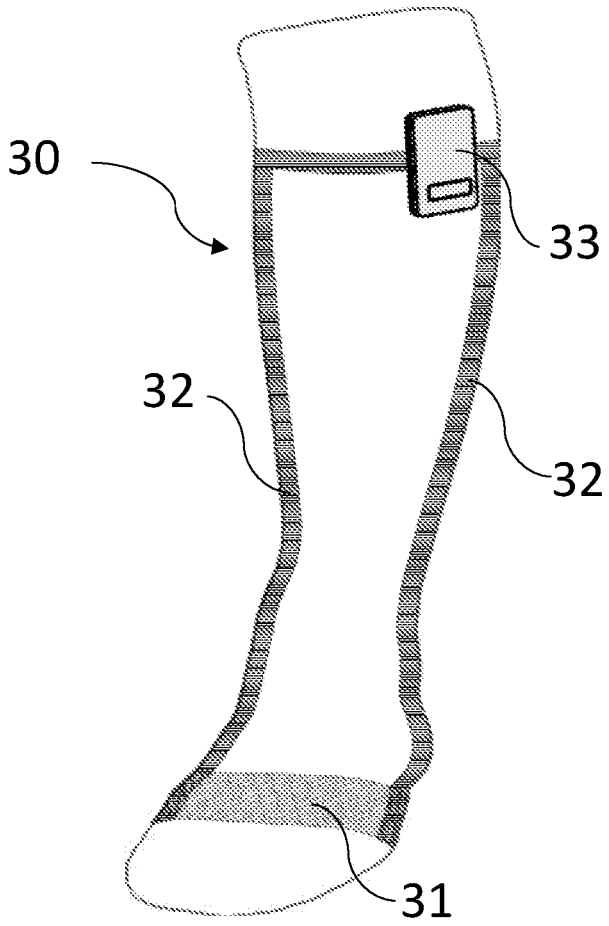
FIG. 8 schematically shows a product in which an electrically conductive yarn is used in order to create a heat emitting area and conductors to and from this area.

FIG. 8 shows an example of a product, in this case an actively heated sock 30, which includes, on the one hand, a heat emitting area 31, which may be realized by means of a low-conductive yarn of the type described above, and on the other hand, conductors 32 which connect the heat emitting area with a battery 33 secured on the sock and which may be realized by means of a high-conductive yarn of the type described above. The sock is knitted from a conventional yarn and the heat emitting yarn and the conductors are knitted into the sock by means of the electrically conductive yarns.

Above it is indicated that the conductive fiber yarn is twisted with a surface conductive filament yarn, one function of the surface conductivity of the filament yarn being to serve as a bridge between the conductive fibers of the fiber yarn. If it would be possible to spin a fiber yarn with conductive fibers that are substantially longer than the conductive fibers which are currently used in conductive fiber yarns then it might be conceivable to realize an electrically conductive yarn with beneficial properties by twisting a fiber yarn with a first length of the conductive fibers with a fiber yarn with a second length of the conducive fibers, the second length being at least the double compared to the first length

The invention claimed is:

1. An electrically conductive yarn, comprising:

a fiber yarn which includes textile fibers and electrically conductive fibers, and a filament yarn which is electrically conductive at least at its surface, wherein;

the fiber yarn is twisted with the filament yarn, and, the filament yarn comprises a core of a plurality of filament fibers and a surface layer of electrically conductive material, with the surface layer of the filament yarn consisting of a thread of electrically conductive material that is wound around the core so that the filament yarn is electrically conductive at its surface along its whole length.

2. The electrically conductive yarn according to claim 1, wherein the filament yarn is elastic in the longitudinal direction of the electrically conductive yarn.

3. The electrically conductive yarn according to claim 1, wherein the filament fibers consist of polyester or carbon fibers.

4. The electrically conductive yarn according to claim 3, wherein the electrically conductive yarn is suitable for creating surfaces for heat emission and conductors for electrical current to and from such surfaces.

5. The electrically conductive yarn according to claim 3, wherein the surface layer of the filament yarn comprises a material selected from the group consisting of, tungsten, electrically conductive polymers, stainless steel, bronze, gold, silver, nickel, copper, brass, magnesium, tin and titanium.

6. The electrically conductive yarn according to claim 3, wherein the resistance per meter of the electrically conductive yarn is 20-2000 Ohm and that the surface layer of the filament yarn comprises a material selected from the group consisting of tungsten, electrically conductive polymers, stainless steel and bronze or any combination thereof.

7. The electrically conductive yarn according to claim 3, wherein the resistance per meter of the electrically conductive yarn is 0.5-20 ohm and that the surface layer of the filament yarn comprises a material selected from the group consisting of gold, silver, nickel, copper, brass, magnesium, tin and titanium or any combination thereof.

8. The electrically conductive yarn according to claim 1, wherein the fiber yarn includes 15-70 weight percent of electrically conductive fibers.

9. The electrically conductive yarn according to claim 1, wherein the electrically conductive fibers are of stainless steel.

10. The electrically conductive yarn according to claim 1, wherein the filament yarn is twisted with at least two fiber yarns so that the filament yarn is positioned in the middle of the electrically conductive yarn with the at least two fiber yarns at the surface of the electrically conductive yarn.

11. The electrically conductive yarn according to claim 1, wherein a filament yarn is twisted with a fiber yarn to form a double yarn, which in turn is twisted with a similar double yarn.

12. A product wherein it includes an electrically conductive yarn according to claim 1.

13. The product according to claim 12, wherein the product is an article of clothing.

14. The product according to claim 12, wherein the product includes an area that is intended for heat emission and conductors which are arranged to conduct current to and from the area, wherein the area and the conductor comprise the electrically conductive yarn.

15. The product according to claim 14, wherein the product is a knitted sock, which is knitted from a conventional yarn and wherein the area and the conductors are knitted into the sock using of the electrically conductive yarn.

16. The electrically conductive yarn according to claim 1, wherein the fiber yarn includes 35-60 weight percent of electrically conductive.

17. The electrically conductive yarn according to claim 1, wherein the fiber yarn includes 40-50 weight percent of electrically conductive fibers.

* * * * *